US011450479B2

(12) United States Patent
Herzer et al.

(10) Patent No.: US 11,450,479 B2
(45) Date of Patent: Sep. 20, 2022

(54) ALLOY AND METHOD FOR PRODUCING A MAGNETIC CORE

(71) Applicant: Vacuumschmelze GmbH & Co. KG, Hanau (DE)

(72) Inventors: Giselher Herzer, Brüchköbel (DE); Viktoria Budinsky, Geiselbach (DE); Christian Polak, Blankenbach (DE)

(73) Assignee: VACUUMSCHMELZE GMBH & CO. KG, Hanau (DE)

( * ) Notice: Subject to any disclaimer, the term of this patent is extended or adjusted under 35 U.S.C. 154(b) by 59 days.

(21) Appl. No.: 16/805,997

(22) Filed: Mar. 2, 2020

(65) Prior Publication Data

US 2020/0279689 A1 Sep. 3, 2020

(30) Foreign Application Priority Data

Mar. 1, 2019 (DE) ..... 10 2019 105215.7

(51) Int. Cl.

| | |
|---|---|
| ***H01F 41/02*** | (2006.01) |
| ***H01F 1/153*** | (2006.01) |
| ***H01F 41/22*** | (2006.01) |
| ***C22C 45/02*** | (2006.01) |
| *H01F 3/10* | (2006.01) |

(52) U.S. Cl.

CPC ..... *H01F 41/0206* (2013.01); *C22C 45/02* (2013.01); *H01F 1/15308* (2013.01); *H01F 1/15333* (2013.01); *H01F 41/22* (2013.01); *H01F 3/10* (2013.01)

(58) Field of Classification Search

None

See application file for complete search history.

(56) References Cited

U.S. PATENT DOCUMENTS 6,425,960 B1 * 7/2002 Yoshizawa ..... H01F 1/15308 148/121

6,507,262 B1 1/2003 Otte et al.

(Continued)

FOREIGN PATENT DOCUMENTS

CN 103502481 A 1/2014

DE 102011002114 A1 10/2012

(Continued)

OTHER PUBLICATIONS

G Herzer, Modern Soft Magnets, Amorphous and Nanocrystalline Materials, Acta Materialia 61 (2013) p. 718-738.

(Continued)

*Primary Examiner* — Xiaowei Su

(74) *Attorney, Agent, or Firm* — Dickinson Wright PLLC

(57) ABSTRACT

An alloy having a formula $Fe_aCo_bNi_cCu_dM_eSi_fB_gX_h$ is provided. M is at least one of V, Nb, Ta, Ti, Mo, W, Zr, Cr, Mn and Hf; a, b, c, d, e, f, g are in at. %; X denotes impurities and optional elements P, Ge and C; and a, b, c, d, e, f, g, h satisfy the following:

$0 \le b \le 4$, $0 \le c < 4$, $0.5 \le d \le 2$, $2.5 \le e \le 3.5$, $14.5 \le f \le 16$, $6 \le g \le 7$, $h < 0.5$, and $1 \le (b+c) \le 4.5$, where a+b+c+d+e+f+g=100.

(Continued)

The alloy has a nanocrystalline microstructure, a saturation magnetostriction of $|\lambda_s| \leq 1$ ppm, a hysteresis loop with a central linear part, and a permeability (μ) of 10,000 to 15,000.

8 Claims, 5 Drawing Sheets

(56) References Cited

U.S. PATENT DOCUMENTS

| | | | | |
|---|---|---|---|---|
| 7,442,263 | B2 * | 10/2008 | Gunther | H01F 1/15308 148/108 |
| 8,298,355 | B2 * | 10/2012 | Yoshizawa | H01F 1/15308 148/403 |
| 2004/0027220 | A1 | 2/2004 | Gunther et al. | |
| 2006/0077030 | A1 | 4/2006 | Herzer et al. | |
| 2008/0129437 | A1 | 6/2008 | Yoshizawa et al. | |
| 2014/0104024 | A1 | 4/2014 | Herzer et al. | |

FOREIGN PATENT DOCUMENTS

| | | | |
|---|---|---|---|
| EP | 1045402 | A2 | 10/2000 |
| EP | 1609159 | A2 | 12/2005 |
| EP | 3522186 | A1 | 8/2019 |
| WO | 0030132 | A1 | 5/2000 |

OTHER PUBLICATIONS

Murillo et al, "Effect of the Annealing Conditions and Grain Size on the Soft Magnetic Character of FeCu (Nb/Ta) SiB Nanocrystalline Alloys", J. Magnetism and Magnetic Materials vol. 218, 2000, No. 1 53-59.

* cited by examiner

ALLOY AND METHOD FOR PRODUCING A MAGNETIC CORE

CROSS-REFERENCE TO RELATED APPLICATION

This U.S. patent application claims the benefit of German Patent Application No. DE 10 2019 105215.7, filed 1 Mar. 2019, the entire contents of which is incorporated herein by reference for all purposes.

BACKGROUND

1. Technical Field

The invention relates to an alloy, particularly an iron-based alloy, and to a method for producing a magnetic core, particularly a toroidal core.

2. Related Art

Amongst metal soft magnetic materials, Fe-based nanocrystalline materials in particular are very promising inductance candidates. These materials have been developed over the last few decades and are being used more and more frequently in both high-quality cores and magnetic components and in shields, antennas and a wide variety of magnetic sensors. Compared to other high-quality metal soft magnetic materials, nanocrystalline foils have good high-frequency characteristics and small losses due to their relatively high specific electrical resistance (typically 100-150 μΩcm) and their production-dependent low strip thickness of approx. 20 μm. As a result, toroidal cores made of these materials compete with soft magnetic ferrites both technically and in terms of cost/benefit ratio due to their significantly smaller size. Of all high-quality soft magnetic materials, nanocrystalline soft magnetic materials have by far the best ageing stability. The optimisation of soft magnetic properties through the formation of alloys and the heat treatment of nanocrystalline metals has concentrated primarily on toroidal cores in the high permeability range with the focus on application frequencies of 50 Hz to approx. 100 kHz.

One example of a nanocrystalline soft magnetic iron-based alloy is $Fe_{73.8}Nb_3Cu_1Si_{15.6}B_{6.6}$, which is commercially available under the trade name of VITROPERM® 800. Until now the properties of existing nanocrystalline soft magnetic materials such as VITROPERM® 800 have limited their use in the production of a wide range of inductances to the high-permeability range of greater than 25,000 to 200,000. However, permeabilities of below 20,000 to 10,000 would be necessary for many applications.

An object is to provide an alloy that has a permeability of between 10,000 and 15,000.

SUMMARY

An aspect of the invention provides an alloy that has a permeability of between 10,000 and 15,000.

The invention provides an alloy comprising a formula $Fe_aCo_bNi_cCu_dM_eSi_fB_gX_h$, where M is at least one of the elements V, Nb, Ta, Ti, Mo, W, Zr, Cr, Mn and Hf; a, b, c, d, e, f, g are given in at. %; X denotes impurities and the optional elements P, Ge and C; and a, b, c, d, e, f, g, h satisfy the following conditions:

$0 \le b \le 4$, $0 \le c < 4$, $0.5 \le d \le 2$, $2.5 \le e \le 3.5$, $14.5 \le f \le 16$, $6 \le g \le 7$, $h < 0.5$, and $1 \le (b+c) \le 4.5$, where a+b+c+d+e+f+g=100, the alloy having a nanocrystalline microstructure in which at least 50 vol. % of the grains have an average size of less than 100 nm, a saturation magnetostriction $|\lambda_s| \le 1$ ppm, preferably $|\lambda_s| < 0.5$ ppm, a hysteresis loop with a central linear part, a permeability of 10,000 to 15,000, preferably 10,000 to 12,000, and a remanence ratio $(B_r/B_s) < 1.5\%$.

Another aspect of the invention provides a method for producing a magnetic core. The method comprises winding a strip made from an amorphous alloy characterised by the formula $Fe_aCo_bNi_cCu_dM_eSi_fB_gX_h$ to form a toroidal core, where M is at least one of the elements V, Nb, Ta, Ti, Mo, W, Zr, Cr, Mn and Hf; a, b, c, d, e, f, g are given in at. %; X denotes impurities and the optional elements P, Ge and C, and a, b, c, d, e, f, g, h satisfy the following conditions:

$0 \le b \le 4$, $0 \le c < 4$, $0.5 \le d \le 2$, $2.5 \le e \le 3.5$, $14.5 \le f \le 16$, $6 \le g \le 7$, $h < 0.5$, and $1 \le (b+c) \le 4.5$, where a+b+c+d+e+f+g=100, heat treating the toroidal core using a magnetic field of 80 kA/m to 200 kA/m perpendicular to the longitudinal direction of the strip using a heat treatment process comprising five stages, where in stage 1 the temperature is increased from room temperature to $T_1$ over a period from time $t_0$ to time $t_1$, where 300° C. 500° C. and $t_1$-$t_0$ is 0.5 h to 2 h, in stage 2 the temperature is increased from $T_1$ to $T_2$ over a period from time $t_1$ to time $t_2$, where 400° C. $T_2$<600° C. and $t_2$-$t_1$ is 0.5 h to 6 h, in stage 3 the temperature is increased from $T_2$ to $T_3$ over a period from time $t_2$ to time $t_3$, where 400° C. $T_3$<650° C. and $t_3$-$t_2$ is 0 h to 1 h, in stage 4 the temperature is held at $T_3$ for a period from time $t_3$ to time $t_{3-1}$, where $t_{3-1}$-$t_3$ is 0.25 h to 3 h, and in stage 5 the temperature is reduced from $T_3$ to room temperature over a period from time $t_{3-1}$ to time $t_4$, where $t_4$-$t_{3-1}$ is 2 h to 4 h.

BRIEF DESCRIPTION OF THE DRAWINGS

A number of embodiments and examples will be explained in greater detail below with reference to the drawings and tables.

DETAILED DESCRIPTION

Figure 1:
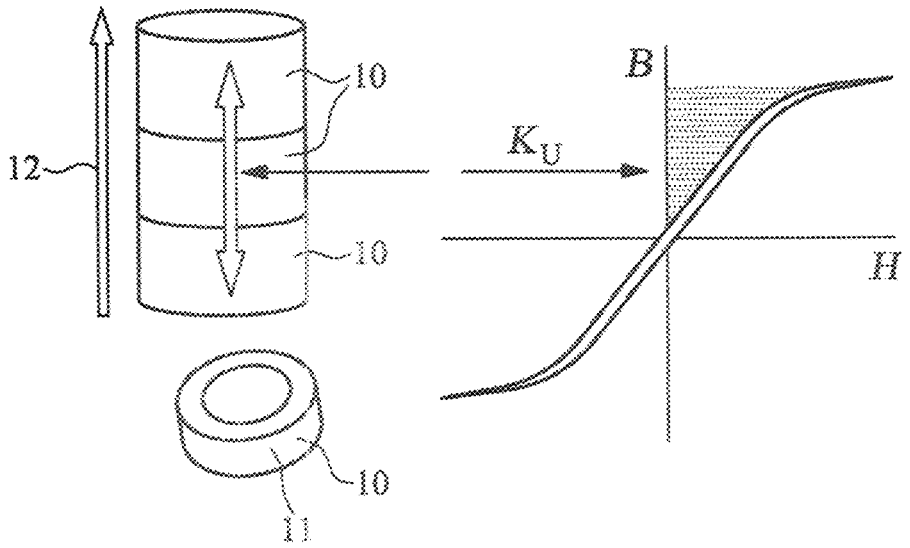
FIG. 1 shows a schematic representation of the stacked toroidal cores during heat treatment.

According to the invention an alloy is provided that is characterised by the formula $Fe_aCo_bNi_cCu_dM_eSi_fB_gX_h$, where M is at least one of the elements V, Nb, Ta, Ti, Mo, W, Zr, Cr, Mn and Hf; a, b, c, d, e, f, g are given in at. %; X denotes impurities and the optional elements P, Ge and C, and a, b, c, d, e, f, g, h satisfy the following conditions:

$0 \le b \le 4$, $0 \le c < 4$, $0.5 \le d \le 2$, $2.5 \le e \le 3.5$, $14.5 \le f \le 16$, $6 \le g \le 7$, $h < 0.5$, and $1 \le (b+c) \le 4.5$, where a+b+c+d+e+f+g=100.

The impurities present may include up to 0.1 wt. % aluminium, up to 0.05 wt. % sulphur, up to 0.1 wt. % nitrogen and/or up to 0.1 wt. % oxygen, and represent up to 0.5 wt. %, preferably up to 0.2 wt. %, preferably up to 0.1 wt. % of the total.

The maximum content of all impurities and P, Ge and C, if one or more of the elements P, Ge and C is present, is less than 0.5 at. % since h<0.5. In some embodiments none of the elements P, Ge and C is present and the maximum content of impurities is therefore less than 0.5 at. %.

The alloy has a nanocrystalline microstructure in which at least 50 vol. % of the grains has an average size of less than 100 nm, a saturation magnetostriction of $|\lambda_s| \le 1$ ppm, a hysteresis loop with a central linear part and a permeability (μ) of 10,000 to 15,000, preferably 10,000 to 12,000.

In iron-based nanocrystalline alloys, however, the magnetostriction and permeability properties are inversely proportionate to one another. EP 1 609 159 B1 discloses an iron-based nanocrystalline alloy with which a permeability of approx. 10,000 can be achieved. However, it has a saturation magnetostriction of 4.4 ppm. U.S. Pat. No. 6,507,262 B2 discloses an iron-based nanocrystalline alloy with a smaller saturation magnetostriction of less than 1 ppm but a permeability of 40,000. As a result, these alloys are not suitable for the desired applications, which require both a permeability of between 10,000 and 15,000 and a low magnetostriction of no more than ±1 ppm.

It has, surprisingly, been established that the iron-based nanocrystalline alloy according to the invention has the desired combination of a permeability of 10,000 to 15,000 and a saturation magnetostriction of $|\lambda_s|<1$ ppm. As a result, it can be used in new applications, for example in components such as soft ferrite magnetic cores, the alloy according to the invention replacing a soft ferrite to produce a component that is smaller in volume without any deterioration in properties.

The lower permeability limit ensures adequate core inductance, while the upper permeability and saturation inductance limits guarantee that the core has a high current-carrying capacity without becoming magnetically saturated. A low magnetostriction of $|\lambda_s|<1$ ppm, preferably 0.5 ppm, prevents the core from reacting with a change in magnetic properties, particularly a change in permeability, should mechanical deformation occur.

The primary field of application for an alloy with a permeability of approx. 10,000 to 12,000 and vanishingly small magnetostriction is the production of common mode chokes for frequency inverters, solar inverters, marine and rail propulsion units and welding machines and the reduction of bearing currents in electric motors and generators. They are, in particular, common mode chokes with medium-high common mode flows or in which a high inductance L is required due to the circuit design. Common mode chokes through which very high currents flow can be produced only with very low-permeability alloys such as VP270 (nominal composition: 5.8 wt. % Ni, 1.0 wt. % Cu, 5.4 wt. % Nb, 6.4 wt. % Si, 1.7 wt. % B, balance Fe), VP250 (nominal composition: 11.6 wt. % Ni, 1.0 wt. % Cu, 5.3 wt. % Nb, 6.2 wt. % Si, 1.7 wt. % B, balance Fe) and VP220 (nominal composition: 11.6 wt. % Ni, 8.1 wt. % Co, 1.0 wt. % Cu, 5.3 wt. % Nb, 5.9 wt. % Si, 1.7 wt. % B, balance Fe), which are commercially available from Vacuumschmelze GmbH & Co KG of Hanau, Germany, or with tension-induced VITROPERM® 500 (nominal composition: 1.0 wt. % Cu, 5.6 wt. % Nb, 8.8 wt. % Si, 1.5 wt. % B, balance Fe), which is also commercially available from Vacuumschmelze GmbH & Co KG of Hanau, Germany.

The advantage of an alloy with vanishingly small magnetostriction becomes attractive with effect from permeabilities above 10,000 since in these cases the induced anisotropy energy $K_u$ ($K_u = \frac{1}{2} B_s^2/(\mu\,\mu_o)$) is comparable to the magneto-elastic interference anisotropy $K_{magel} = \frac{3}{2}\lambda_s\,\sigma$, where $\lambda_s$ is magnetostriction and σ is mechanical stress or pressure. This means that external stresses or pressures on the core can influence magnet quality (hysteresis loop form). This influence can be minimised if magnetostriction $\lambda_s$ is reduced towards zero since this eliminates the magneto-elastic interference anisotropy $K_{magel}$. If magnetostriction was not virtually zero in these cases, it would be necessary to prevent any mechanical stresses or pressures at the core caused by the winding of the core with copper wire. In most cases this would not be possible. In low-permeability alloys such as VP270, VP250 and VP220, some of which have high positive magnetostriction, magnet quality can of course also be influenced by external stresses and pressures on the core. However, the induced anisotropy energy $K_u$ ($K_u$=½ $B_s^2/(\mu \mu_o)$) is also significantly greater and the disturbing effect can therefore be kept low.

The central part of the hysteresis loop is defined as the part of the hysteresis loop between the anisotropy field strength points that characterise the transition to saturation. A linear part of this central part of the hysteresis loop is defined by a non-linearity factor NL, it being possible to calculate and describe this non-linearity factor NL using the formula $$NL(\%) = \frac{100}{2}(\delta B_{auf} + \delta B_{ab})/B_s. \quad (1)$$

Here $\delta B_{auf}$ and $\delta B_{ab}$ denote the standard deviation of the magnetic polarisation from a line of best fit through the ascending or descending branch of the hysteresis loop between polarisation values of ±75% of the saturation polarisation $B_s$. As a result, the smaller NL, the more linear the loop. The alloys according to the invention have an NL value of less than 0.8%.

This form of hysteresis loop can be achieved by the heat treatment of the amorphous alloy in a magnetic field that is oriented perpendicular to the longitudinal direction of the strip.

Moreover, as well as a permeability of 10,000 to 15,000, preferably of 11,000 to 14,000 or 10,000 to 12,000, the alloy can also have a saturation magnetostriction of $|\lambda_s| \leq 0.5$ ppm, preferably 0.1 ppm, and a saturation inductance of greater than 1.0 T. A saturation inductance of greater than 1.0 T together with a permeability of 10,000 to 15,000 can guarantee high pre-current-carrying capacity. It can also have a remanence ratio (Br/Bs) of <1.5% and/or a coercive field strength of $H_c$<1 A/m and/or an anisotropy field of $H_k \geq 60$ A/m, preferably 70 Nm.

In one embodiment the alloy contains nickel, with $0.2 \leq c < 4$.

In one embodiment X denotes carbon (C) and the carbon content of the alloy is h<0.5.

In one embodiment at least one element from the group Nb, Ta and Mo is present as M, where 2.5<e<3.5.

Niobium (Nb) can be replaced as desired also including completely by tantalum (Ta) and partially up to 0.6 at. % by molybdenum (Mo). In some embodiments the sum of Nb, Ta and Mo is 2.5 at. %<(Nb+Ta+Mo)<3.5 at. %.

In some embodiments the alloy contains nickel, where $0.2 \leq c < 4$, preferably $0.5 \leq c \leq 4$, preferably $0.2 \leq c \leq 3$, preferably $0.5 \leq c \leq 3$.

In some embodiments the alloy contains cobalt, where $0.2 \leq b < 4$, preferably $0.5 \leq b \leq 4$, preferably $0.2 \leq b \leq 3$, preferably $0.5 \leq c \leq 3$.

In some embodiments the alloy contains both Co and Ni, in each case in a minimum concentration of 0.2 at. % and a maximum concentration of 3 at. %, the total concentration of the two elements not exceeding 4.5 at. % such that 0.2<b 3 and $0.2 < c \leq 3$ and $1 \leq (b+c) \leq 4.5$.

In some embodiments the alloy contains both Co and Ni, in each case in a minimum concentration of 0.5 at. % and a maximum concentration of 3 at. %, the total concentration of the two elements not exceeding 4.5 at. % such that 0.5<b 3 and $0.5 < c \leq 3$ and $1 \leq (b+c) \leq 4.5$.

According to the invention a magnetic core containing an alloy according to one of the preceding embodiments is also provided. In one embodiment the magnetic core takes the form of a toroidal core that is wound from a strip with a thickness of less than 50 μm.

The wound layers of the toroidal core can be electrically insulated from one another to reduce eddy current losses. This electrical insulation can be provided by applying an electrically insulating coating to one or both sides of the strip or by embedding or dipping the wound toroidal core in an electrically insulating adhesive or resin.

The magnetic core, which can also take the form of a toroidal core, can be used in a so-called CMC (Common Mode Choke) for high-performance applications. For the most part these applications require a one-turn CMC and have a DC level of max. approx. 20 A. One such example is a magnetic core with the following dimensions: internal diameter (di)=76 mm, external diameter (da)=110 mm, core height=strip width (h)=25 mm. When producing a core of this type from a nanocrystalline material with a strip thickness of approx. 18+1-3 μm and a core fill factor of approx. 80% between 650 and 900 strip layers are wound in the amorphous state to form a toroidal core.

The magnetic core can be provided using the following method. A strip made of an amorphous alloy characterised by the formula $Fe_aCo_bNi_cCu_dM_eSi_fB_gX_h$ is wound to form a toroidal core, M being at least one of the elements V, Nb, Ta, Ti, Mo, W, Zr, Cr, Mn and Hf; a, b, c, d, e, f, g are given in at. %; X denotes impurities and the optional elements P, Ge and C, and a, b, c, d, e, f, g, h satisfy the following conditions:

$0 \leq b \leq 4$, $0 \leq c < 4$, $0.5 \leq d \leq 2$, $2.5 \leq e \leq 3.5$, $14.5 \leq f \leq 16$, $6 \leq g \leq 7$, $h < 0.5$, and $1 \leq (b+c) \leq 4.5$, $1 \leq (b+c) \leq 4.5$, where a+b+c+d+e+f+g=100.

The toroidal core is heated treated using a magnetic field of 80 kA/m to 200 kA/m oriented perpendicular to the longitudinal direction of the strip. In one embodiment the toroidal core is heat treated in the magnetic field at a temperature of 400° C. to 650° C. for 0.25 hours to 3 hours.

In one embodiment the heat treatment process comprises five stages:

- in stage 1 the temperature is increased from room temperature to $T_1$ over a period from time $t_0$ to time $t_1$, where 300° C. 500° C. and $t_1$-$t_0$ is 0.5 h to 2 h,
- in stage 2 the temperature is increased from $T_1$ to $T_2$ over a period from time $t_1$ to time $t_2$, where 400° C. $T_2$<600° C. and $t_2$-$t_1$ is 0.5 h to 6 h, in stage 3 the temperature is increased from $T_2$ to $T_3$ over a period from time $t_2$ to time $t_3$, where 400° C. $T_3$<650° C. and $t_3$-$t_2$ is 0 h to 1 h, in stage 4 the temperature is held at the plateau temperature $T_3$ for a period from time $t_3$ to time $t_{3-1}$, where $t_{3-1}$-$t_3$ is 0.25 h to 3 h, and in stage 5 the temperature is reduced from $T_3$ to room temperature over a period from time $t_{3-1}$ to time $t_4$, where $t_4$-$t_{3-1}$ is 2 h to 4 h.

Table 1 summarises the properties of comparison alloys. Table 1 shows the composition, the density (ρ) in the nanocrystalline state, the polarisation ($J_s$) in the amorphous and nanocrystalline states, the magnetostriction ($\lambda_s$) in the nanocrystalline state and the permeability (μ) in the nanocrystalline state of the commercially available nanocrystalline alloys VP 220, VP 250, VP 270 and VP 800, which have a flat hysteresis loop.

TABLE 1

| Alloy | Composition [at. %] | ρ (nano) [g/cm³] | $J_s$ (amorph/ nano) [T] | $\lambda_s$ (nano) [ppm] | μ (F-type) |
|---|---|---|---|---|---|
| VP 220 | Fe—$Ni_{10}Co_7Cu_{0.8}Nb_{2.9}Si_{10.6}B_8$ | 7.62 | 1.19/1.26 | 10-11 | 1800-2500 |
| VP 250 | Fe—$Ni_{10}Cu_{0.8}Nb_{2.9}Si_{11}B_8$ | 7.55 | 1.18/1.25 | 8-9 | 2800-4000 |
| VP 270 | Fe—$Ni_5Cu_{0.8}Nb_{2.9}Si_{11.5}B_8$ | 7.50 | 1.24/1.32 | 6-7 | 4700-5100 |
| VP 800 | Fe—$Cu_1Nb_3Si_{15.6}B_{6.6}$ | 7.35 | 1.21/1.24 | <0.5 | 20,000-200,000 |

This heat treatment can be used to fine tune magnetostriction so that $|\lambda_s|\leq 0.5$ ppm or $|\lambda_s\uparrow\leq 0.1$ ppm is achieved. In one embodiment $T_3$ lies between 520° C. and 620° C., preferably between 560° C. and 620° C., to achieve a saturation magnetostriction of $|\lambda_s|\leq 0.5$ ppm.

In one embodiment the period $t_3$-$t_2$ in stage 3 of heat treatment is greater than 0 h, i.e. 0 h<$t_3$-$t_2$≤1 h.

The impurities present may include up to 0.1 wt. % aluminium, up to 0.05 wt. % sulphur, up to 0.1 wt. % nitrogen and/or up to 0.1 wt. % oxygen, and represent up to 0.5 wt. %, preferably up to 0.2 wt. %, preferably up to 0.1 wt. % of the total.

The maximum content of all impurities and P, Ge and C, if one or more of the elements P, Ge and C is present, is less than 0.5 at. % since h<0.5. In some embodiments none of the elements P, Ge and C is present and the maximum content of impurities is therefore less than 0.5 at. %.

During heat treatment the field strength of the magnetic field can be varied or held constant. During heat treatment the magnetic field can be switched on or off.

In one embodiment at least three cores, preferably at least 25 cores, are stacked one on top of another and heat treated in this stack. This stacked arrangement of magnetic cores during heat treatment results in an improvement in the linearity of the hysteresis loop, which can be described by the non-linearity factor.

The amorphous strip can be produced using a rapid solidification technology and have a maximum thickness of 50 μm, preferably 25 μm.

In one embodiment the strip is provided with an electrically insulating layer on at least one of its two surfaces prior to winding. The electrically insulating layer can be used to reduce eddy currents and so eddy current losses.

In one embodiment X denotes carbon (C) and h denotes the carbon content of the alloy, h being <0.5.

In one embodiment at least one element from the group Nb, Ta and Mo is present as M, where 2.5<e<3.5. Niobium Nb can be replaced as desired including completely by tantalum (Ta) and partially up to 0.6 at. % by molybdenum (Mo). In some embodiments the sum of Nb, Ta and Mo is 2.5 at. %<(Nb+Ta+Mo)<3.5 at. %.

In some embodiments the alloy contains both Co and Ni, each in a minimum concentration of 0.5 at. % and a maximum concentration of 3 at. %, the total concentration of the two elements not exceeding 4.5 at. % such that 0.5<b 3 and 0.5<c≤3 and 1≤(b+c)≤4.5.

This comparison shows that the alloys have either a low permeability of below approx. 5,500 with a high magnetostriction of more than 6 ppm (VP 220, VP 250, VP 270) or a low magnetostriction with a high permeability (VP 800) of at least 20,000. As permeability drops, so magnetostriction increases to clearly above 1 ppm. The magnetostriction and permeability properties are inversely proportionate to one another.

In some applications it would, however, be possible to achieve structural improvements were an alloy with both a low magnetostriction of $|\lambda_s|$<1 ppm, preferably 0 to +1 ppm, particularly preferably 0 to +0.5 ppm, and a permeability of lower than 20,000, preferably in the range of 10,000 to 15,000, to be present.

According to the invention, this combination of properties is provided by an alloy consisting of $Fe_aCo_bNi_cCu_dM_eSi_fB_gX_h$, where M is at least one of the elements V, Nb, Ta, Ti, Mo, W, Zr, Cr, Mn and Hf; a, b, c, d, e, f, g are given in at. %; X denotes impurities and the optional elements P, Ge and C, and a, b, c, d, e, f, g, h satisfy the following conditions:

$0\leq b\leq 4$, $0\leq c<4$, $0.5\leq d\leq 2$, $2.5\leq e\leq 3.5$, $14.5\leq f\leq 16$, $6\leq g\leq 7$, $h<0.5$, and $1\leq(b+c)\leq 4.5$, where a+b+c+d+e+f+g=100.

In one advantageous version the alloy has Co and Ni as M, where 1≤(b+c)≤4.5, preferably 2≤(b+c)≤4.2 and 1≤b≤3 and 1≤c<2.

The impurities present may include up to 0.1 wt. % aluminium, up to 0.05 wt. % sulphur, up to 0.1 wt. % nitrogen and/or up to 0.1 wt. % oxygen, and represent up to 0.5 wt. %, preferably up to 0.2 wt. %, preferably up to 0.1 wt. % of the total.

The maximum content of all impurities and P, Ge and C, if one or more of the elements P, Ge and C is present, is less than 0.5 at. % since h<0.5. In some embodiments none of the elements P, Ge and C is present and the maximum content of impurities is therefore less than 0.5 at. %.

The alloy can be produced in the form of an amorphous strip by means of a rapid solidification technology. To produce a magnetic core in the form of a toroidal core, the amorphous strip is wound to form a toroidal core and heat treated using a magnetic field oriented perpendicular to the longitudinal direction of the strip, thereby creating a nanocrystalline microstructure in which at least 50 vol. % of the grains have an average size of less than 100 nm and the desired combination of a small magnetostriction and a permeability in the desired range of 10,000 to 15,000.

Further features of the versions according to the invention are a maximum inductance at H=200 A/m of at least 1.2 T, a non-linearity factor NL of less than 1%, a remanence ratio $B_r/B_m$ of less than 1.5%, a coercive field strength $H_c$ of less than 1 A/m, an anisotropy field $H_k$ (magnetic field from which magnetic saturation is achieved) of at least 60 A/m, preferably at least 70 A/m.

FIG. 1 shows a schematic representation of the stacked toroidal cores 10 during heat treatment and shows that the magnetic field is applied perpendicular to the longitudinal direction of the strip 11, as indicated by the arrow 12. The stacking of the magnetic cores 10 one on top of another is used to improve the linearity of the hysteresis loop. A magnetic field of 80 kA/m to 200 kA/m can be used. The strength of the magnetic field can be varied during heat treatment, e.g. switched on and off, or kept almost constant.

Table 2 summarises the compositions and magnetic properties of various alloys. Examples 1 to 5 do not form part of the invention as claimed, while examples 6 to 16 do form part of the present invention. Examples 11 to 16 represent preferable examples. The samples take the form of toroidal cores wound from the amorphous alloy. The wound toroidal cores are stacked one on top of another on annealing trays, for example, and heated treated in this stacked state. The samples are heat treated at 570° C. in a magnetic field of approx. 200 kA/m for 0.5 h oriented perpendicular to the longitudinal direction of the strip. At least three toroidal cores and advantageously more than 25 toroidal cores can be stacked one on top of another in order to improve the linearity of the hysteresis loop.

Figure 2:
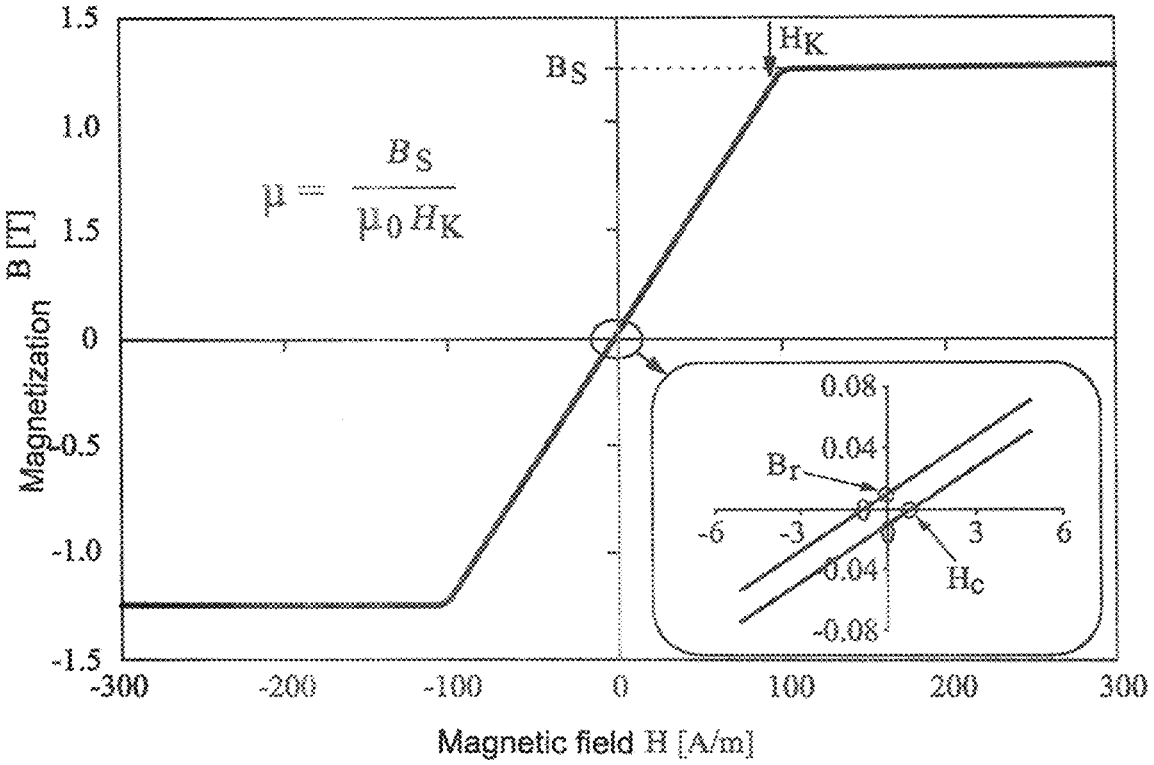
FIG. 2 shows an example of a flat hysteresis loop.

The alloys according to the invention have a linear or flat hysteresis loop (F-loop). FIG. 2 shows an example of a flat hysteresis loop with high linearity properties. One measure of the linearity of the hysteresis loop is the non-linearity ratio described by the non-linearity factor NL (in %), which can be calculated using the formula below:

$$NL(\%) = \frac{100}{2}(\delta B_{auf} + \delta B_{ab})/B_s.$$

Here $\delta B_{auf}$ and $\delta B_{ab}$ denote the standard deviation of the magnetic polarisation from a line of best fit through the ascending or descending branch of the hysteresis loop between polarisation values of ±75% of the saturation polarisation $B_s$. As a result, the smaller NL, the more linear the loop. This form of hysteresis loop can be achieved by the heat treatment of the amorphous alloy in a magnetic field that is oriented perpendicular to the longitudinal direction of the strip, as illustrated in FIG. 1.

In addition, FIG. 2 explains the terms remanence ratio ($B_r/B_m$), coercive field strength ($H_c$), anisotropy field ($H_k$) and permeability (μ).

TABLE 2

| No. | Fe | Co | Ni | Cu | Nb | Si | B | C | $B_m$ [T] | NL [%] | $B_r/B_m$ [%] | $H_c$ [A/m] | $H_k$ [A/m] | μ | $\lambda_s$ [ppm] |
|---|---|---|---|---|---|---|---|---|---|---|---|---|---|---|---|
| 1 | 73.8 | 0 | 0 | 1.0 | 3 | 15.5 | 6.7 | | 1.19 | 0.4 | 0.8 | 0.4 | 46 | 20 600 | 0.1 |
| 2 | 74.3 | 0 | 0 | 0.8 | 2.8 | 15.5 | 6.6 | | 1.24 | 0.5 | 1.1 | 0.5 | 50 | 19 900 | 0.0 |
| 3 | 75.9 | 0 | 0 | 0.8 | 2.8 | 13.5 | 7 | | 1.31 | 0.3 | 0.9 | 0.7 | 77 | 13 700 | 1.3 |
| 4 | 75.9 | 0 | 0 | 0.8 | 2.8 | 12.5 | 8 | | 1.32 | 0.3 | 1.1 | 0.8 | 80 | 13 100 | 2.6 |
| 5 | 70.3 | 0 | 4 | 0.8 | 2.8 | 15.5 | 6.6 | | 1.22 | 0.4 | 0.7 | 0.8 | 127 | 7 700 | 1.3 |
| 6 | 75.9 | 0 | 0 | 0.8 | 2.8 | 2.8 | 6 | | 1.30 | 0.4 | 1.0 | 0.6 | 74 | 13 900 | 0.3 |
| 7 | 70.3 | 2 | 2 | 0.8 | 2.8 | 15.5 | 6.6 | | 1.24 | 0.5 | 0.8 | 0.7 | 105 | 9 400 | 0.8 |
| 8 | 70.3 | 4 | 0 | 0.8 | 2.8 | 15.5 | 6.6 | | 1.25 | 0.4 | 0.8 | 0.6 | 78 | 12 800 | 0.2 |
| 9 | 72.3 | 2 | 0 | 0.8 | 2.8 | 15.5 | 6.6 | | 1.24 | 0.7 | 1.1 | 0.7 | 64 | 15 500 | 0.1 |
| 10 | 72.3 | 0 | 2 | 0.8 | 2.8 | 15.5 | 6.6 | | 1.24 | 0.4 | 0.8 | 0.6 | 85 | 11 600 | 0.7 |
| 11 | 72.3 | 1 | 1 | 0.8 | 2.8 | 15.5 | 6.6 | | 1.24 | 0.7 | 1.1 | 0.7 | 73 | 13 400 | 0.4 |
| 12 | 72.4 | 1 | 1 | 0.8 | 2.8 | 15.5 | 6 | 0.5 | 1.25 | 0.6 | 0.9 | 0.6 | 73 | 13 700 | 0.3 |
| 13 | 71.9 | 1.5 | 1.0 | 0.8 | 2.8 | 15.5 | 6.5 | | 1.24 | 0.4 | 1.0 | 0.7 | 77 | 12 700 | 0.3 |
| 14 | 70.3 | 2.5 | 1.6 | 0.8 | 2.8 | 15.5 | 6.5 | | 1.23 | 0.5 | 1.0 | 0.8 | 96 | 10 200 | 0.5 |
| 15 | 69.8 | 2.4 | 1.6 | 0.8 | 2.8 | 16.0 | 6.6 | | 1.21 | 0.4 | 0.9 | 0.7 | 85 | 11 400 | 0.1 |
| 16 | 70.4 | 2.4 | 1.6 | 0.8 | 2.8 | 15.5 | 6 | 0.5 | 1.24 | 0.5 | 0.7 | 0.6 | 96 | 10 400 | 0.4 |

Examples 1-5 are not embodiments according to the invention
Examples 6-16 are embodiments according to the invention
Examples 11-16 are preferable embodiments according to the invention Examples 6 to 16 in Table 2 represent exemplary alloys according to the invention, examples 11 to 16 being preferable. Examples 6 provides the desired properties by a minor reduction in the silicon and boron content. In certain circumstances, however, the small total metalloid content (Si+B) requires special measures during the production of the strip in order to guarantee clean glass formation. Example 7 only just reaches the lower limit and example 9 only just reaches the upper limit of the desired permeability range of μ=10,000 to 15,000. Due to the relatively high Co content, example 8 has higher raw materials costs, a feature that is undesirable in some embodiments. At 0.7 ppm, example 10 has a magnetostriction that might be too high for some applications. Examples 11 to 16, on the other hand, all have a permeability in the target range of 10,000 to 15,000 and a magnetostriction ($\lambda_s$) of less than or equal to 0.5 ppm. These properties of the alloys according to the invention can be set by adjusting the heat treatment process.

Figure 3:
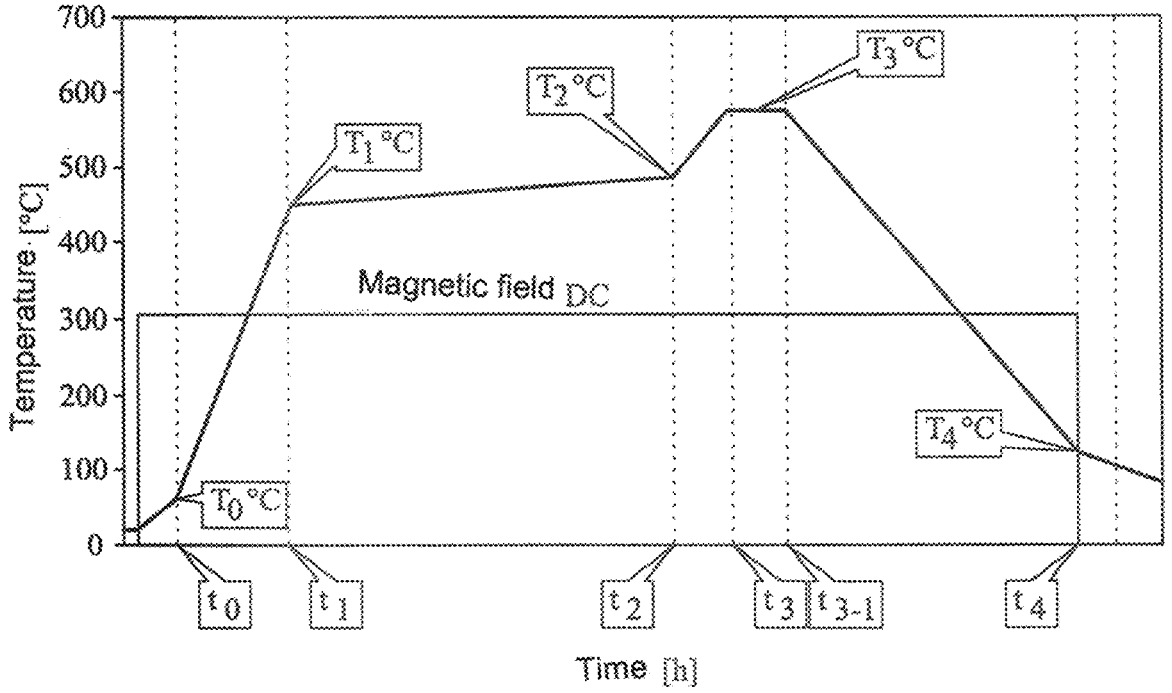
FIG. 3 shows a diagram of temperature and magnetic field management as a function of time for the heat treatment of toroidal cores in the magnetic field.

FIG. 3 shows a diagram of temperature and magnetic field management as a function of time for the heat treatment of toroidal cores coiled in the amorphous state using the alloys according to the invention, in the magnetic field, in order to create the nanocrystalline microstructure and the desired magnetic properties. In one embodiment the heat treatment process comprises five stages, which are illustrated graphically in FIG. 3.

At stage 1 the temperature is increased from room temperature $T_0$ to $T_1$ over a period from time $t_0$ to time $t_1$, where 300° C. $T_1$ 500° C. and $t_1$-$t_0$ is 0.5 h to 2 h. At stage 2 the temperature is increased from $T_1$ to $T_2$ over a period from time $t_1$ to time $t_2$, where 400° C. $T_2$<600° C. and $t_2$-$t_1$ is 0.5 h to 6 h. At stage 3 the temperature is increased from $T_2$ to $T_3$ over a period from time $t_2$ to time $t_3$, where 400° C. $T_3$<650° C. and $t_3$-$t_2$ is 0 h to 1 h. At stage 4 the temperature is held at the plateau temperature $T_3$ for a period from time $t_3$ to time $t_{3-1}$, where $t_{3-1}$-$t_3$ is 0.25 h to 3 h. At stage 5 the temperature is reduced from $T_3$ to room temperature $T_4$ over a period from time $t_{3-1}$ to time $t_4$, where ($t_4$-$t_{3-1}$) is 2 h to 4 h. This heat treatment can be used to adjust permeability and particularly magnetostriction in order to provide the desired combination of a permeability of 10,000 to 15,000, preferably 10,000 to 12,000, and $|\lambda_s|\leq 0.5$ ppm, the toroidal core also having a saturation inductance greater than 1.0 T and a hysteresis loop with a central linear part.

Figure 4:
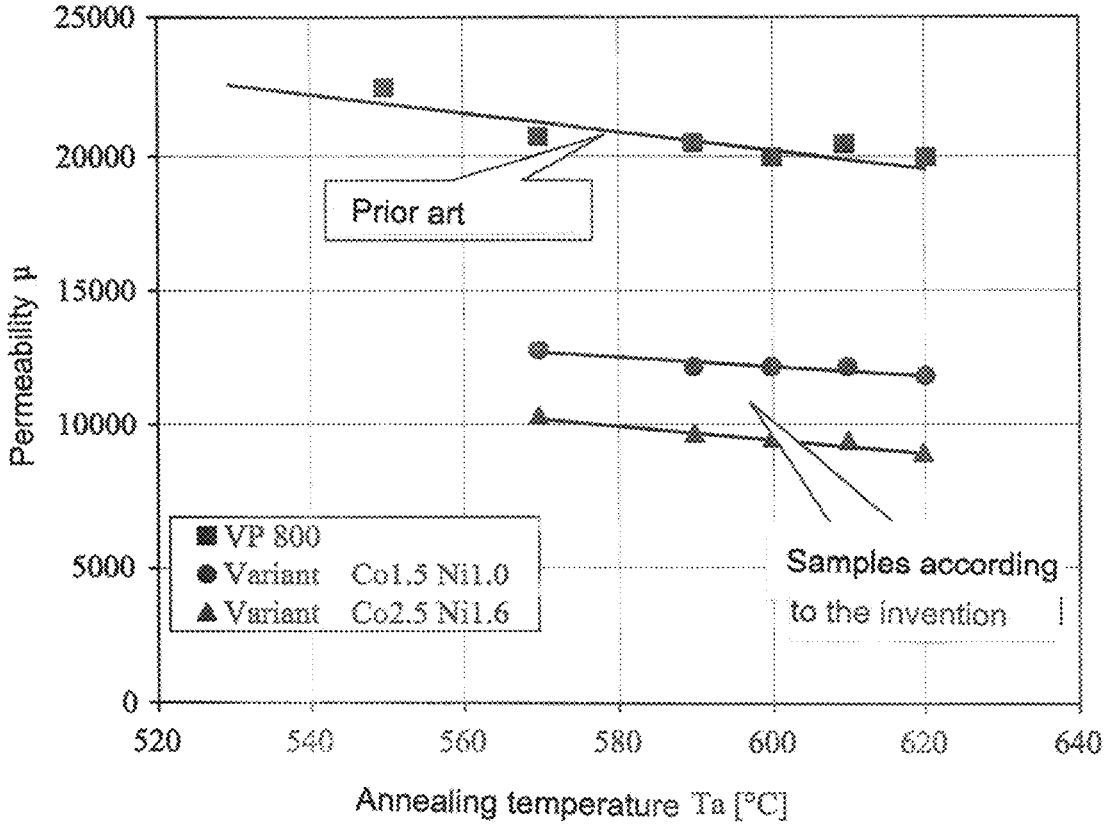
FIG. 4 shows a diagram of permeability dependent on annealing temperature.

FIG. 4 shows a diagram of permeability dependent on annealing temperature, i.e. the plateau temperature $T_3$ at stage 4 of the heat treatment process in FIG. 3, for two alloys according to the invention and one comparative example. FIG. 4 shows the permeability ρ after crystallisation in the perpendicular field at annealing temperatures of 530° C. to 620° C. for the comparator alloy VP 800 (Fe—$Cu_1$ $Nb_3$ $Si_{15.5}$ $B_{6.5}$), which does not form part of the present invention, and the alloys Fe—$Cu_{0.8}$ $Co_{1.5}$ $Ni_{1.0}$ $Nb_{2.8}$ $Si_{15.5}$ $B_{6.5}$ and Fe—$Cu_{0.8}Co_{2.5}$ $Ni_{1.6}$ $Nb_{2.8}$ $Si_{15.5}$ $B_{6.5}$ according to the invention. These results show that it is possible to achieve a lower permeability in the desire range of 10,000 to 15,000 with the composition according to the invention.

Figure 5:
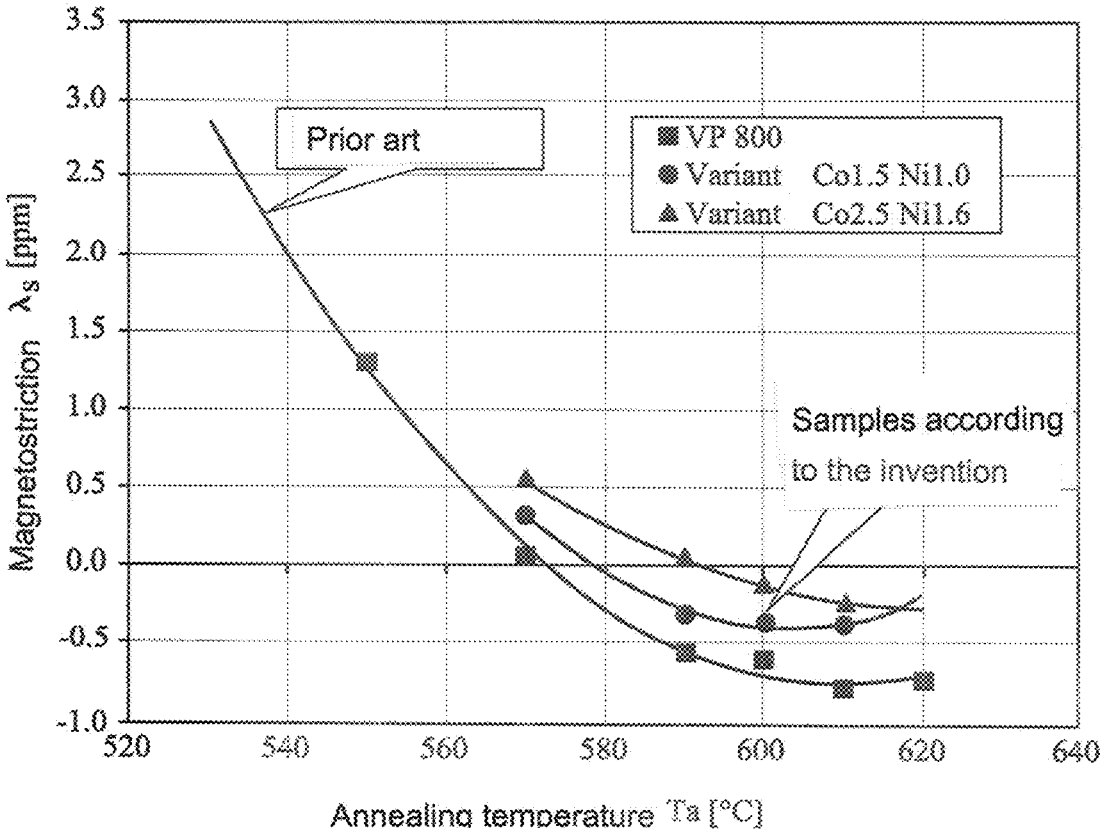
FIG. 5 shows a diagram of saturation magnetostriction dependent on annealing temperature.

FIG. 5 shows a diagram of saturation magnetostriction $\lambda_s$ dependent on the annealing temperature, i.e. the plateau temperature $T_3$ at stage 4 of the heat treatment process in FIG. 3, for two alloys according to the invention and one comparative example. These results show that it is possible to achieve a saturation magnetostriction of $|\lambda_s|\leq 0.5$ ppm by adjusting the annealing temperature for the alloys according to the invention.

As demonstrated by FIGS. 4 and 5, it is possible to further fine tune the magnetic parameters μ and $\lambda_s$ by varying the annealing temperature. This is particularly true for magnetostriction, but it barely changes permeability. As shown in FIG. 5, magnetostriction can be changed from positive to negative values by choosing the appropriate annealing temperature in a range of 560° C. to 620° C. It is therefore possible to compensate for the magnetostriction, particularly for the preferred embodiments ($|\lambda_s|\leq 0.5$ ppm), by adjusting the annealing temperature to almost "zero".

Table 3 summarises the results of two nanocrystalline alloys that have a flat hysteresis loop achieved by heat treatment in a magnetic field oriented perpendicular to the longitudinal direction of the strip, a magnetostriction ($\lambda_s$) of max.±1 ppm and a permeability (μ) of 10,000 to 12,000.

TABLE 3

| Example | Composition [at. %] | ρ (nano) [g/cm³] | $J_s$ (amorph/ nano) [T] | $\lambda_s$ (nano) [ppm] | μ (F-type) |
|---|---|---|---|---|---|
| A | Fe—$Ni_{1.6}Co_{2.5}Cu_{0.8}Nb_{2.8}Si_{15.5}B_{6.5}$ | 7.39 | 1.22/1.24 | ~1 | 10000 |
| B | Fe—$Ni_1Co_{1.5}Cu_{0.8}Nb_{2.8}Si_{15.5}B_{6.5}$ | 7.38 | 1.23/1.25 | ~0.5 | 12000 |

The permeability (μ) and the magnetostriction value ($\lambda_s$) of this alloy can be further fine tuned by varying the annealing temperature using the heat treatment process illustrated in FIG. 3. This is particularly true for magnetostriction, but it barely changes permeability. Magnetostriction can be changed from positive to negative values by choosing the appropriate annealing temperature in a range of 560° C. to 620° C. It is therefore possible to compensate for the magnetostriction, particularly for the preferred embodiments ($|\lambda_s|\leq 0.5$ ppm), by adjusting the annealing temperature to almost "zero".

To achieve the induced anisotropy $K_u$ or permeability reduction whilst maintaining the best possible soft magnetic properties, particularly the lowest possible coercive field ($H_c$) and a magnetostriction of $\lambda_s$~0, the following approach can be employed to select an appropriate composition for the alloy system $Fe_aCo_bNi_cCu_dM_eSi_fB_gX_h$. It takes into account three factors A), B) and C).

Simple perpendicular field tempering can be used on toroidal cores made of strips of the alloy $Fe_{bal}Cu_1Nb_3Si_{15.5}B_{6.6}$ (VITROPERM® VP800) to increase induced anisotropy $K_u$ to max. approx. 30 J/m³. This corresponds to a permeability of approx. μ=20000. In this alloy system the addition of the elements Co and/or Ni to compensate for the Fe content increases the potential for the creation of a uniaxial anisotropy. With appropriate heat treatment the induced anisotropy can be increased drastically in comparison to the Co- and/or Ni-free system, and the permeability can be reduced significantly.

At a given saturisation magnetisation $B_s$, the correlation $\mu \sim 1/K_u$, or more precisely:

$$K_u = \frac{1}{2}\frac{B_s^2}{\mu_0 \mu}$$

applies.

Factor A): Increase $K_u$

Figure 6:
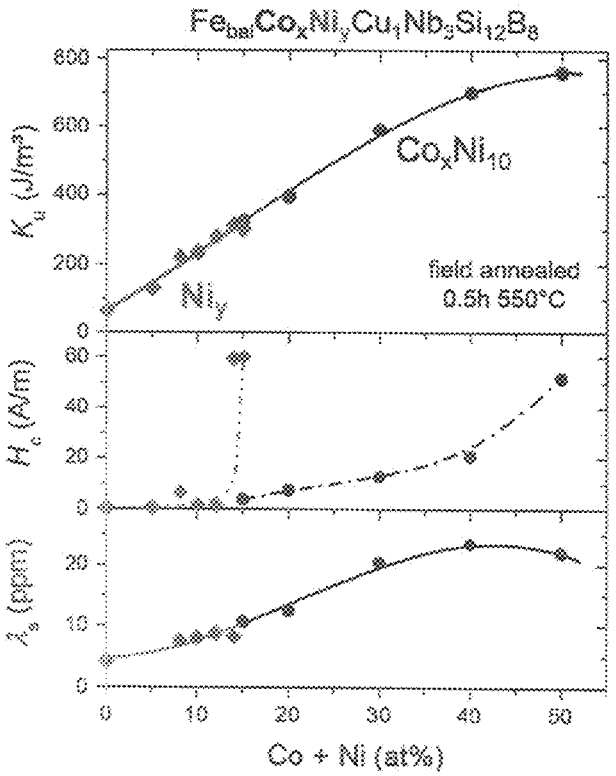
FIG. 6 shows a diagram of the anisotropy energy $K_u$, of the coercive field $H_c$ and the magnetostriction $\lambda_s$ as a function of the Co and Ni contents in at. % in the alloy system $Fe_{bal}Co_xNi_yCu_1Nb_3Si_{12}B_8$.

FIG. 6 shows a diagram of the anisotropy energy $K_u$, the coercive field $H_c$ and the magnetostriction $\lambda_s$ as a function of the Co and Ni content in at % in the alloy system $Fe_{bal}Co_xNi_yCu_1Nb_3Si_{12}B_8$.

In FIG. 6 the achievable anisotropy energy $K_u$ in the alloy system $Fe_{bal}Co_xNi_yCu_1Nb_3Si_{12}B_8$ is shown by the addition of Co and Ni. In this alloy system with a Si content of 12 at % and a B content of 8 at % the effects of the addition of Co and Ni on the induced anisotropy and the soft magnetic properties can be observed particularly well. An increase in the Co and/or Ni content results in a rise in the anisotropy energy. This can be explained by the fact that the presence of Fe—Co and Fe—Ni pairs of atoms leads to an increase in the degrees of freedom for the formation of a field-induced anisotropy $K_u$.

Figure 7:
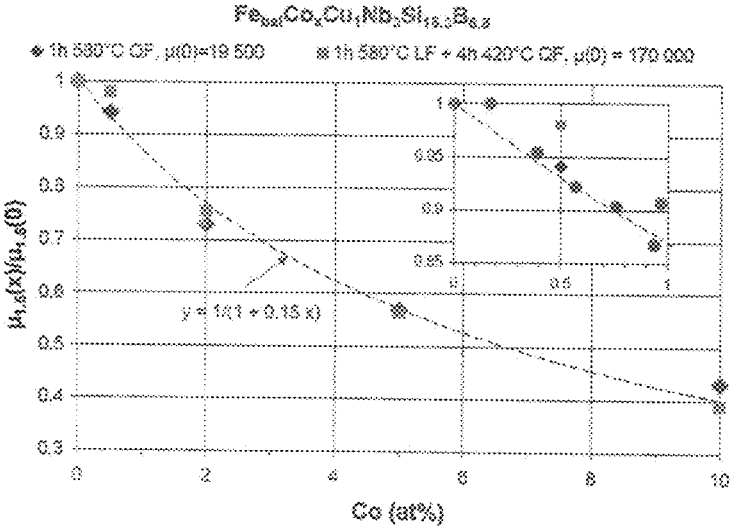
FIG. 7 shows a diagram of the fraction of the initial permeability ρ of $Fe_{bal}Co_xCu_1Nb_3Si_{15.3}B_{6.8}$ achieved by adding Co as a function of the Co content in at % as compared to an alloy without added Co, i.e. with x=0, for two different heat treatment processes in the magnetic field. The diagram also indicates the permeability achieved for x=0.

FIG. 7 shows a diagram of the initial permeability ρ of $Fe_{bal}Co_xCu_1Nb_3Si_{15.3}B_{6.8}$ as a function of the Co content at %. The insert provides additional data with very small Co contents. FIG. 7 shows that with the addition of Co to the alloy system $Fe_{bal}Co_xCu_1Nb_3Si_{15.3}B_{6.8}$ (the alloy system according to the invention) initial permeability can be reduced by increasing Co content or the induced anisotropy Ku increases. In the range below 1 at % Co content, initial permeability decreases linearly with Co content and the effect flattens out strongly at higher contents.

Factor B): Maintain magnetostriction at almost "zero"

To maintain the good soft magnetic properties and the very good loss properties of the alloy $Fe_{bal}Cu_1Nb_3Si_{15.5}B_{6.6}$ (VITROPERM® VP800) in the desired alloys with the addition of Co and Ni, attention is paid to the remaining residual magnetostriction $\lambda_s$ after the nanocrystallisation process. FIG. 6 shows the residual magnetostriction $\lambda_s$ after the nanocrystallisation in the alloy system $Fe_{bal}Co_xNi_yCu_1Nb_3Si_{12}B_8$ resulting from the addition of Co and Ni. In this alloy system with a Si content of 12 at % and a B content of 8 at % the effects of the addition of Co and Ni on the induced anisotropy and the soft magnetic properties can be observed particularly well. Once again, an increase in Co and/or Ni content results in a rise in residual magnetostriction. FIG. 6 shows this for a very broad range of additions of Co and/or Ni.

Figure 8:
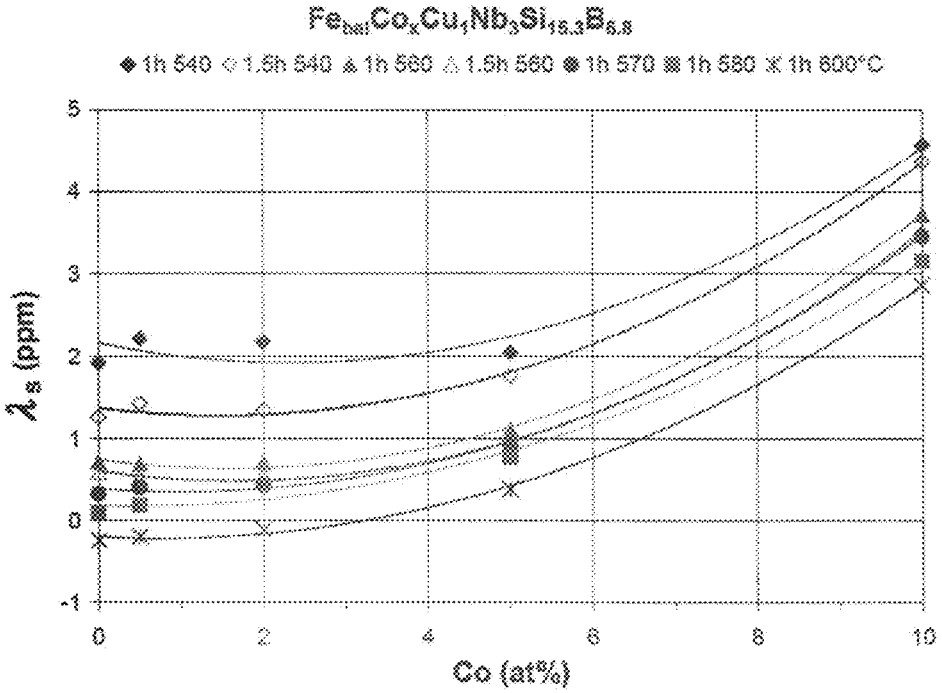
FIG. 8 shows a diagram of saturation magnetostriction $\lambda_s$ as a function of the Co content in at % in the alloy system $Fe_{bal}Co_xCu_1Nb_3Si_{15.3}B_{6.8}$ for various annealing temperatures $T_a$ between 540° C. and 600° C.

FIG. 8, which shows the influence of Co content in at % on saturation magnetostriction $\lambda_s$ of $Fe_{bal}Co_xCu_1Nb_3Si_{15.3}B_{6.8}$ (the alloy system according to the invention) for various annealing temperatures $T_a$ between 540° C. and 600° C., gives a more precise correlation.

Figure 9:
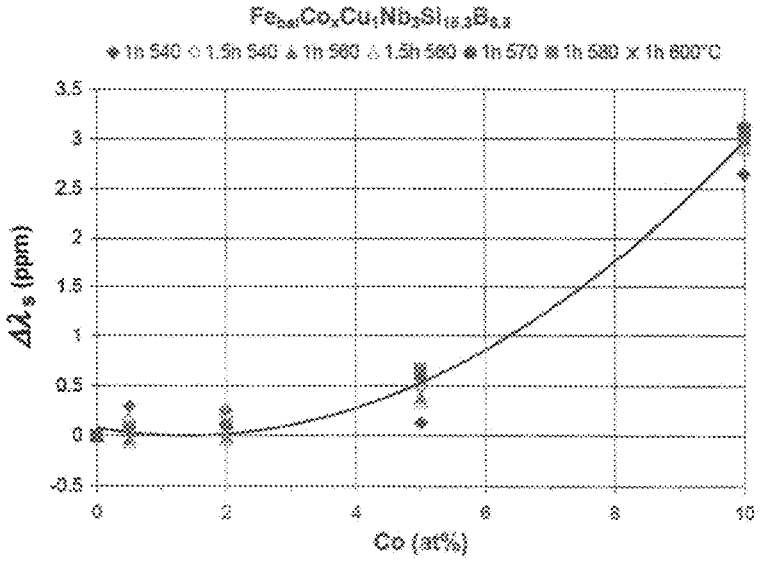
FIG. 9 shows a diagram of saturation magnetostriction $\lambda_s$ as a function of the Co content in at % in the alloy system $Fe_{bal}Co_xCu_1Nb_3Si_{15.3}B_{6.8}$ for various annealing temperatures $T_a$ between 540° C. and 600° C.

FIG. 9 shows the change in the saturation magnetostriction $\lambda_s$ of $Fe_{bal}Co_xCu_1Nb_3Si_{15.3}B_{6.8}$ in the Co content range from 0 to 10 at %. At lower additions of Co (less than 2 at %) saturation magnetostriction $\lambda_s$ rises only slightly; at higher contents the rate of change increases strongly.

Factor C): Maintain the smallest possible coercive field

To maintain the good soft magnetic properties and the very good loss properties of the alloy $Fe_{bal}Cu_1Nb_3Si_{15.5}B_{6.6}$ (VITROPERM® VP800) in the desired alloys with Co and Ni additions, attention is also paid to the remaining coercive field $H_c$ after the nanocrystallisation process. FIG. 6 shows the change in the coercive field $H_c$ after the nanocrystallisation process in the alloy system $Fe_{bal}Co_xNi_yCu_1Nb_3Si_{12}B_8$. In principle, here again an increase in the Co- and/or Ni content also results in a rise in the coercive field H. This can be explained by the fact that with the presence of Fe and Co/Ni it is no longer possible to fully average out the local crystalline anisotropy of a-FeSi nanocrystallites. In addition, however, it is recognised that the coercive field also increases when Ni alone is added.

As a result of the findings set out under A), B) and C), it is proposed to use a combination of Co and Ni in the range of <4.5 at % in the alloy system based on $Fe_{bal}Cu_1Nb_3Si_{15.5}B_{6.6}$ as additional alloy components to increase the induced anisotropy $K_u$ and to achieve the desired reduced permeability range. Both Co and Ni and a combination of the two result in an increase in induced anisotropy. It is shown that too high a Co content causes saturation magnetostriction $\lambda_s$ to increase strongly. For this reason, a combination of Co and Ni can advantageously be used to partly replace a necessary Co content by Ni for a given anisotropy. By the same token, the selected Ni content must not be too high if the coercive field $H_c$ is to be kept as low as possible.

It is for this reason that minimum concentrations and maximum concentrations of Co and Ni are respected in some embodiments. Some embodiments contain both Co and Ni, in each case in a minimum concentration of 0.2 at %, preferably 0.5 at %, and a maximum concentration of 3 at %, the total concentration of the two elements not exceeding 4.5 at %.

The aim of a first example containing both Co and Ni is to provide a permeability of p=10000 following perpendicular field annealing. The addition of approx. 4 to 4.5 at % of foreign elements to replace the Fe would be required to achieve an induced anisotropy $K_u$ of 60 J/m$_3$. If the entire amount (4 to 4.5 at %) were replaced by the element Co, though it would be possible to achieve the desired anisotropy and so to reduce the permeability to p=10000, magnetostriction would increase strongly into the positive and it would be impossible to maintain the good soft magnetic properties. As a result the necessary amount is divided between Co and Ni.

According to factor B) there is only a slight increase in saturation magnetostriction $\lambda_s$ up to a Co content of 2 at %. On the other hand, according to factor C), the chosen Ni content should not be too high if a rapid increase in the coercive field $H_c$ is to be avoided. Consequently, a Co content of 2.5 at % and a Ni content of 1.6 at % can be chosen to achieve the desired combination of properties. See alloy A in Table 3.

The aim of a second example containing both Co and Ni is to achieve a permeability of μ=12000 following perpendicular field annealing. The addition of approx. 2.5 to 3 at % of foreign elements to replace the Fe would be required to achieve an induced anisotropy $K_u$ of 50 J/m$_3$. If the entire amount (2.5 to 3 at %) were replaced by the element Co, though it would be possible to achieve the desired induced anisotropy and so to reduce the permeability to μ=12000, magnetostriction would increase into the positive as already set out above and it would therefore be impossible to maintain all of the soft magnetic properties. As a result the necessary amount is divided between Co and Ni.

According to factor B) there is only a slight increase in saturation magnetostriction $\lambda_s$ up to a Co content of 2 at %. On the other hand, according to factor C), the chosen Ni content should not be too high if a rapid increase in the coercive field $H_c$ is to be avoided. Consequently, a combination of a Co content of 1.5 at % and a Ni content of 1 at % can be chosen. See Table 3 and alloy B.

Consequently, a Co content of 2.5 at % and a Ni content of 1.6 at % can be chosen to achieve the desired combination of properties. See alloy A in Table 3.

The invention claimed is:

1. A method for producing a magnetic core, comprising: winding a strip made from an amorphous alloy comprising the formula $Fe_aCo_bNi_cCu_dM_eSi_fB_gX_h$ to form a toroidal core, where M is at least one of the elements V, Nb, Ta, Ti, Mo, W, Zr, Cr, Mn and Hf; a, b, c, d, e, f, g are given in at. %; X denotes impurities and the optional elements P, Ge and C; and a, b, c, d, e, f, g, h satisfy the following conditions:

$0 \le b \le 4$, $0 \le c < 4$, $0.5 \le d \le 2$, $2.5 \le e \le 3.5$, $14.5 \le f \le 16$, $6 \le g \le 7$, $h<0.5$, and $1 \leq (b+c) \leq 4.5$, where a+b+c+d+e+f+g=100, heat treating the toroidal core using a magnetic field of 80 kA/m to 200 kA/m perpendicular to the longitudinal direction of the strip using a heat treatment process comprising five stages, where in stage 1 the temperature is increased from room temperature to $T_1$ over a period from time $t_0$ to time $t_1$, where 300° C.≤$T_1$≤500° C. and $t_1$-$t_0$ is 0.5 h to 2 h, in stage 2 the temperature is increased from $T_1$ to $T_2$ over a period from time $t_1$ to time $t_2$, where 400° C.≤$T_2$≤600° C. and $t_2$-$t_1$ is 0.5 h to 6 h, in stage 3 the temperature is increased from $T_2$ to $T_3$ over a period from time $t_2$ to time $t_3$, where 400° C.≤$T_3$≤650° C. and 0 h<$t_3$ $t_2$≤1 h, in stage 4 the temperature is held at $T_3$ for a period from time $t_3$ to time $t_{3-1}$, where $t_3$-$t_3$ is 0.25 h to 3 h, in stage 5 the temperature is reduced from $T_3$ to room temperature over a period from time $t_{3-1}$ to time $t_4$, where $t_4$-$t_{3-1}$ is 2 h to 4 h, and after the heat treatment process, the alloy having a nanocrystalline microstructure in which at least 50 vol. % of the grains have an average size of less than 100 nm, a saturation magnetostriction $|\lambda_s| \leq 1$ ppm, a hysteresis loop with a central linear part, a permeability of 10,000 to 15,000, and a remanence ratio (Br/Bs)<1.5%.

2. A method according to claim 1, wherein $T_3$ lies between 520° C. and 620° C. to achieve a saturation magnetostriction of $|\lambda_s| \leq 1$ ppm.

3. A method according to claim 1, wherein the field strength of the magnetic field is varied or held constant during heat treatment.

4. A method according to claim 1, wherein the magnetic field is switched on or off during heat treatment.

5. A method according to claim 1, wherein at least three cores are stacked one on top of the other and heat treated.

6. A method according to claim 1, in which at least one of the two surfaces of the strip is provided with an electrically insulating layer prior to winding.

7. A method according to claim 1, wherein after the heat treatment process, the alloy has a saturation magnetostriction $|\lambda_s| \leq 0.5$ ppm, and a permeability of 10,000 to 12,000.

8. A method according to claim 1, wherein 0.5≤b≤3 and 0.5≤c≤3 in the formula $Fe_aCo_bNi_cCu_dM_eSi_fB_gX_h$.

* * * * *